US006436484B1

(12) United States Patent
Broome et al.

(10) Patent No.: US 6,436,484 B1
(45) **Date of Patent: *Aug. 20, 2002**

(54) PROCESSES FOR COATING SEWING THREAD

(75) Inventors: Gordon H. Broome; J. Keith Powell; Yanda Jin; Patricia W. DeFoor, all of Toccoa, GA (US)

(73) Assignee: Coats American, Inc., Charlotte, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/987,655

(22) Filed: Dec. 9, 1997

(51) Int. Cl.[7] ..... C08J 7/04

(52) U.S. Cl. ..... 427/513; 427/385.5; 427/514; 427/558; 427/559; 427/595

(58) Field of Search ..... 427/513, 514, 427/558, 559, 595, 385.5

(56) References Cited

U.S. PATENT DOCUMENTS

| | | | |
|---|---|---|---|
| 1,943,818 | A | 1/1934 | Fantone et al. |
| 2,647,488 | A | 8/1953 | Shive |
| 2,787,980 | A | 4/1957 | McDermott |
| 2,875,092 | A | 2/1959 | Cline |
| RE25,164 | E | 5/1962 | Cline |
| 3,090,664 | A | 5/1963 | Cline et al. |
| 3,179,485 | A | 4/1965 | Kawasaki |
| 3,247,043 | A | 4/1966 | Cardina |
| 3,332,393 | A | 7/1967 | Hoover |
| 3,502,495 | A | 3/1970 | Akamatsu |
| 3,507,608 | A | 4/1970 | Eirich |
| 3,698,899 | A | 10/1972 | Giberstein |
| 3,775,150 | A | 11/1973 | McClary |
| 3,882,819 | A | 5/1975 | Skeeters |
| 3,952,552 | A | 4/1976 | Rozner |
| 3,988,108 | A | 10/1976 | Segoshi et al. |
| 4,076,510 | A | 2/1978 | Mracek et al. |
| 4,108,748 | A | 8/1978 | Portnoy et al. |
| 4,175,972 | A | 11/1979 | Crivello |
| 4,194,462 | A | 3/1980 | Knowles |
| 4,230,766 | A | 10/1980 | Gaussens et al. |
| 4,239,868 | A | 12/1980 | Bonnet et al. |
| 4,258,646 | A | 3/1981 | Kloczewski et al. |
| 4,263,337 | A | 4/1981 | Login |
| 4,263,370 | A | 4/1981 | Login |
| 4,264,483 | A | 4/1981 | Laufer et al. |

(List continued on next page.)

FOREIGN PATENT DOCUMENTS

| | | |
|---|---|---|
| DE | 44 20 088 | 12/1995 |
| EP | 0 153 829 A1 | 9/1985 |
| EP | 0 492 649 | 12/1991 |

(List continued on next page.)

OTHER PUBLICATIONS

"Cyracure", Cycloaliphatic Epoxides, Union Carbide (No date avail.).
"Uvacure", Epoxide Resin Systems for Cationic UV Cure, Radcure (No date avail.).

*Primary Examiner*—Bernard Pianalto
(74) *Attorney, Agent, or Firm*—Alston & Bird LLP

(57) ABSTRACT

Processes for coating sewing thread using a radiation curable composition and the resultant coated sewing thread. Sewing thread is coated with a radiation curable composition, which exhibits a self sustaining cure after exposure to radiation. The composition is applied using contact coating techniques to coat and impregnate the thread with resin. The coated thread is then exposed to radiation to cure the coating. Because the cure is self sustaining, the composition more fully and completely reacts to form a coating with increased durability and reduced susceptibility to stripping or flaking during use in demanding industrial applications.

24 Claims, 7 Drawing Sheets

U.S. PATENT DOCUMENTS

| | | | |
|---|---|---|---|
| 4,287,228 | A | 9/1981 | Schlesinger |
| 4,294,190 | A | 10/1981 | Ohis |
| 4,333,963 | A | 6/1982 | Emmons et al. |
| 4,342,794 | A | 8/1982 | Völker et al. |
| 4,390,238 | A | 6/1983 | Van Der Hoek |
| 4,430,853 | A | 2/1984 | Scott et al. |
| 4,440,802 | A | 4/1984 | Irving |
| 4,479,984 | A | 10/1984 | Levy et al. |
| 4,501,588 | A | 2/1985 | Suzuki et al. |
| 4,507,350 | A | 3/1985 | Hendrix et al. |
| 4,533,570 | A | 8/1985 | Iyengar |
| 4,593,051 | A | 6/1986 | Koleske |
| 4,652,488 | A | 3/1987 | Willemsen et al. |
| 4,662,307 | A | 5/1987 | Amos et al. |
| 4,818,776 | A | 4/1989 | Koleske |
| 4,835,193 | A | 5/1989 | Hayase et al. |
| 4,874,798 | A | 10/1989 | Koleske et al. |
| 4,892,764 | A | 1/1990 | Drain et al. |
| 4,932,978 | A | 6/1990 | Gavend et al. |
| 4,963,300 | A | 10/1990 | Meier et al. |
| 5,000,981 | A | 3/1991 | McGarry et al. |
| 5,034,279 | A | 7/1991 | Wilson, Jr. et al. |
| RE33,677 | E | 8/1991 | Vazirani |
| 5,039,549 | A | 8/1991 | Nguyen et al. |
| 5,140,054 | A | 8/1992 | Miller et al. |
| 5,171,609 | A | 12/1992 | Ury |
| 5,219,623 | A | 6/1993 | Petisce |
| 5,227,229 | A | 7/1993 | McMahan McCoy et al. |
| 5,236,464 | A | 8/1993 | Green et al. |
| 5,237,917 | A | 8/1993 | Traut et al. |
| 5,240,971 | A | 8/1993 | Eckberg et al. |
| 5,247,147 | A | 9/1993 | Boniort et al. |
| 5,287,606 | A | 2/1994 | Ruef |
| 5,298,361 | A | 3/1994 | Bonham |
| 5,318,808 | A | 6/1994 | Crivello et al. |
| 5,334,421 | A | 8/1994 | McNutt |
| 5,350,604 | A | 9/1994 | Crivello |
| 5,352,392 | A | 10/1994 | Johnson et al. |
| 5,369,205 | A | 11/1994 | Eckberg et al. |
| 5,372,858 | A | 12/1994 | Saylor, III |
| 5,390,400 | A | 2/1995 | Jacob et al. |
| 5,409,504 | A | 4/1995 | Fritzsche |
| 5,409,740 | A | 4/1995 | Brann |
| 5,447,797 | A | 9/1995 | Stapp et al. |
| 5,449,408 | A | 9/1995 | Koaizawa et al. |
| 5,451,355 | A | 9/1995 | Boissonnat et al. |
| 5,501,734 | A | 3/1996 | Oliphant |
| 5,534,558 | A | 7/1996 | Minns |
| 5,539,013 | A | 7/1996 | Eckberg et al. |
| 5,679,115 | A | 10/1997 | Fritzsche et al. |
| 5,869,182 | A | 2/1999 | Ebert et al. |

FOREIGN PATENT DOCUMENTS

| | | |
|---|---|---|
| EP | 0 496 117 | 12/1991 |
| FR | 1300057 | 12/1962 |
| FR | 1435755 | 6/1966 |
| FR | 2031719 | 11/1970 |
| GB | 917437 | 2/1963 |
| JP | 49-034972 | 3/1974 |
| JP | 50-095854 | 7/1975 |
| JP | 50-115277 | 9/1975 |
| JP | 51-136732 | 11/1976 |
| JP | 58-057199 | 12/1983 |
| JP | 60-65748 | 4/1985 |
| JP | 63-270854 | 11/1988 |
| JP | 3-68475 | 3/1991 |
| JP | 3-294592 | 12/1991 |
| JP | 4-108132 | 4/1992 |
| JP | 4-202846 | 7/1992 |
| JP | 4-202865 | 7/1992 |
| JP | 4-202868 | 7/1992 |
| JP | 4-316678 | 11/1992 |
| WO | WO 93/22943 | 11/1993 |

PROCESSES FOR COATING SEWING THREAD

FIELD OF THE INVENTION

This invention relates to processes for coating sewing thread, and in particular to processes for coating sewing thread using solventless systems.

BACKGROUND OF THE INVENTION

Sewing thread is typically constructed from multiple continuous filament multifilament plies which are individually twisted in one direction and then combined by twisting in the opposite direction to produce a multiple ply final thread. In general, this causes the separate plies to act as a single unitary ply during the sewing process.

In many highly demanding industrial environments, it can be necessary to further treat sewing thread prior to its use. Such treatments can improve the integrity and retention of individual filaments within the sewing thread under conditions of high abrasion, improve the adhesion of the plies or individual filaments to each other in monocord or multicord constructions, and improve durability of the thread in its final end use. In these instances, the thread is coated with a bonding agent in the form of a lacquer or other plastic material which essentially forms a solid yet flexible film or sheath surrounding the thread. This allows the thread to retain substantial flexibility because the individual filaments of the thread retain the ability to have some movement relative to each other.

If the bonding agent fully penetrates the cross-section of the thread, however, the individual filaments are bound to each other and a stiff thread results. Such a stiff thread performs similar to a monofilament thread and can be unacceptable for many end use applications.

Conventionally, sewing thread is coated by passing the thread through a suitable resin in a solvent and then through a heating oven which evaporates the solvent and leaves the film. This operation, however, can be slow and releases organic solvent materials into the atmosphere. In addition, the film or sheath tends to flake off the sewing thread when used in demanding applications. The flaking is highly undesirable because it produces a visible dandruff-like deposit on the product. Further, energy required to remove the solvent can increase production costs.

Solventless systems can avoid many problems associated with solvent based coatings. In an exemplary solventless system, sewing thread is coated with a prepolymer material (such as a monomer plus a catalyst) which is capable of reacting to form a film when exposed to ultraviolet (UV) radiation. However, radiation curable systems also tend to flake off the sewing thread when the sewing thread is used in demanding applications. Other problems which can be associated with the use of many solventless systems include incomplete cure, tackiness, low adhesion and low production speeds.

SUMMARY OF THE INVENTION

The present invention provides processes for coating sewing thread using solventless systems. The solventless systems are generally more environmentally acceptable than conventional solvent based systems. In addition, the solventless systems can be applied to the thread and then cured in an in-line process at a greatly increased rate as compared to solvent based processes, which can reduce production costs. Solvent or water does not have to be removed from the solventless system after coating, thus reducing energy costs. In addition, sewing thread can be coated using smaller sized equipment, thus reduction production space.

In contrast to prior solventless systems, however, the coated sewing thread exhibits improved resistance to flaking and powdering. In addition, the coated sewing threads of the invention can have excellent adhesion properties which can protect the thread surface during demanding high speed industrial applications.

In the invention, a radiation curable material or resin system is applied in-line to a continuous threadline. When the thus coated thread is exposed to radiation, the radiation initiates polymerization or cure of the resin. In contrast to prior solventless systems, however, the radiation initiates a reaction that is self sustaining following initiation, as explained below.

Preferably, the radiation curable system is a cationic initiated system in which the radiation initiates a self sustaining crosslinking reaction following initiation, in contrast to many radiation cured polymers which are based upon a free radical mechanism. In the latter type mechanism, it is currently believed that the reaction only proceeds in the presence of UV radiation. However, in the case of a sewing thread, it is believed that at least a portion of the resin applied to the thread is shielded from the UV radiation by the individual filaments in the thread. Thus, for free radical initiated UV resins, the shielded portion of the resin is never fully reacted and hardened.

In contrast, for cationic initiated resins, the shielded portion of the resin is hardened as a result of the self sustaining thermal reaction initiated by the UV radiation even though the shielded portion of the resin is never irradiated directly. As a result, the cationic initiated systems cure or react more completely and as a result do not suffer from the tacking and flaking problems associated with free radical radiation curable resins.

In the invention, to coat the sewing thread, the sewing thread is passed through a cavity in a coating apparatus which contains the radiation curable material under pressure. The radiation curable material is applied to the thread in the cavity using a "contact coating" process in which the pressurized radiation curable resin is applied to the exterior of the sewing thread as the sewing thread is contacted by a surface so as to impregnate resin into the periphery of the sewing thread. In one embodiment of the invention, contact coating is achieved by employing a coating die having an orifice of smaller diameter than the diameter of the sewing thread. Alternatively, a deformable porous media can be provided in the die cavity so that it surrounds and contacts the sewing thread as it passes through the cavity. As a result of contact coating, the resultant sewing thread exhibits a thin layer of radiation curable material that has been impregnated into the periphery of the sewing thread.

Following curing of the radiation curable coating, the sewing thread of the invention differs structurally from conventional organic solvent based coated sewing thread because the radiation curable composition is applied so that the composition penetrates into the periphery of the sewing thread, preferably to a depth of one to about three single filament layers (or diameters), and the peripheral filaments are bonded to each other and in some cases to the next interior level of filaments. Although the composition penetrates the thread, the degree of penetration is controlled to prevent the thread from becoming unduly stiff. Thus, a continuous sheath of resin is not formed around the sewing thread, in contrast with conventional coated sewing thread;

instead, the coating extends into the periphery of the thread. This can advantageously minimize or prevent stripping of the coating caused by abrasive forces such as are encountered in sewing processes.

BRIEF DESCRIPTION OF THE DRAWINGS

Some of the features and advantages of the invention having been described, others will become apparent from the detailed description which follows, and from the accompanying drawings, in which.

DETAILED DESCRIPTION OF THE INVENTION

In the following, a detailed description of the preferred embodiment of the invention is given. It will be recognized that although specific terms are used, they are used in a descriptive and not in a limiting sense in that the invention is susceptible to numerous variations and equivalents within the spirit and scope of the description of the invention.

Figure 1:
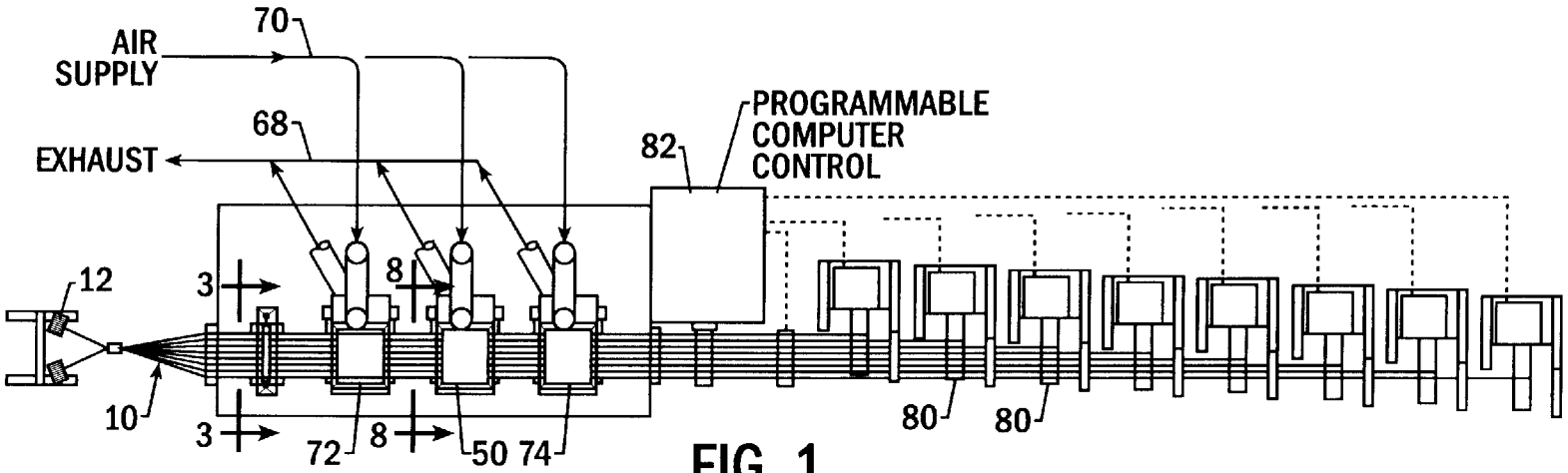
FIG. 1 is a top view of an exemplary apparatus for coating sewing thread in accordance with the invention.
Figure 2:
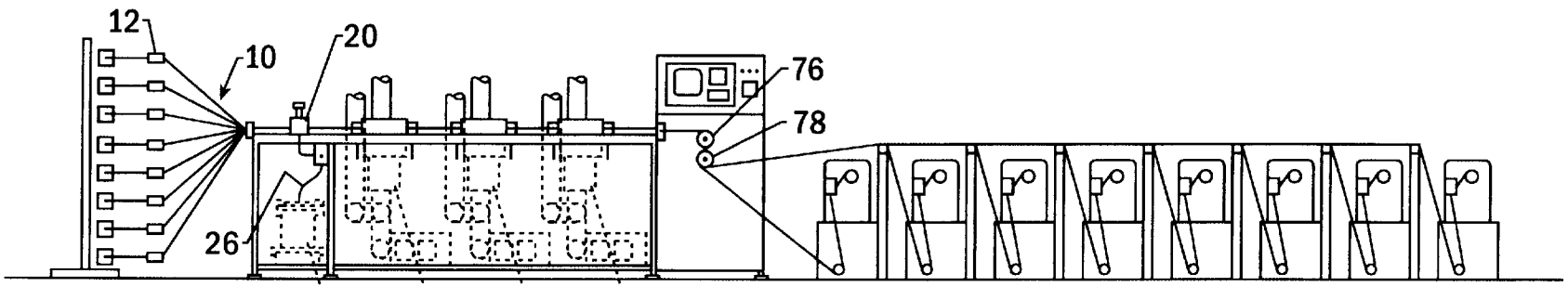
FIG. 2 is a side view of the apparatus of FIG. 1.

Referring to FIGS. 1 and 2, an exemplary process and apparatus for coating sewing thread in accordance with the invention is illustrated. FIGS. 1 and 2 illustrate a system for in-line coating of multiple threadlines. The skilled artisan, however, will appreciate that the invention can include coating more or fewer threadlines than illustrated.

The threadlines, designated generally as 10, are directed from supply packages 12 into a coating apparatus, designated generally as 20, via entry ports 22. The threadlines can be preconditioned or pretreated to provide moisture levels desirable for a particular resin system, for example, by minimizing exposure of the threadlines to atmospheric humidity and/or removing moisture from the threadlines prior to coating. The threadlines can be preheated, for example, using a standard UV unit, prior to entry into the coating apparatus.

Typically, a threadline comprises one or more multifilament plies which are individually twisted in a first direction and then combined by twisting in an opposite direction to produce a multi-ply thread construction. The threadline, however, can include one, two, or more than three multifilament plies or other structures used to form sewing thread as will be apparent to the skilled artisan. The multifilament plies are typically composed of a relatively high tenacity multifilament continuous filaments such as nylon, polyester or the like. By way of illustration, the individual or single multifilament plies typically have a denier (decitex) within the range of from about 50 to about 500 denier (56–556 decitex). Thus, the thread illustrated in FIG. 1 (comprising three individual multifilament plies) typically has a total denier ranging from about 150 to about 2,000 denier (167 to about 2,222 decitex).

As illustrated in FIG. 2, a resin supply source 24 supplies a radiation curable composition (which also can be preheated) to a resin distribution manifold via line 26 and into coating apparatus 20. As used herein, and as will be appreciated by the skilled artisan, the term "radiation curable composition" refers to compositions which photopolymerize or cure upon exposure to radiation. Generally the composition includes polymerizable compounds, including monomers, oligomers, polymers, prepolymers, resinous materials, and mixtures thereof, and a photoinitiator, which when exposed to a source of radiation, initiates a reaction of the polymerizable materials. The radiation curable composition may be polymerized to form homopolymers or copolymerized with various other monomers.

In the invention, the preferred polymerizable compounds cure cationically, and the photoinitiator generates a proton on exposure to radiation, typically ultraviolet (UV) radiation. This cation causes the polymerizable compounds to crosslink. The cationic cure is advantageous because it is self generating. In contrast, most radiation curable compositions that are widely used in commerce are cured via a free radical mechanism in which the photoinitiator generates free radicals upon exposure to radiation, which in turn attack and initiate polymerization of unsaturated polymerizable compounds. For the polymerization to take place, the composition must be exposed to the radiation source; once the radiation source is removed, the reaction stops because free radicals are no longer generated. Thus unreacted material can remain in the coating unless all of the coating is exposed to radiation. In such cases, the coating tends to flake and/or tack.

In contrast, the cationic initiated reaction is self generating, i.e., the reaction continues after the radiation source is removed. Such compositions can provide an improved protective coating for sewing thread because the composition can more fully cure, that is, essentially all available polymerizable components of the composition are reacted. As result, essentially no flaking is observed when the thread is used.

Preferred cationically curable compounds include epoxy resins. As the skilled artisan will appreciate, radiation curable compounds other than epoxy resins can be used in the invention so long as the curing or polymerization thereof is self sustaining after the reaction is initiated by exposure to radiation. Epoxy compounds or resins suitable for use in the invention include those materials having at least one polymerizable epoxy group per molecule, and preferably two or more such groups per molecule. The epoxides can be monomeric or polymeric, saturated or unsaturated, and include aliphatic, cycloaliphatic, aromatic and heterocyclic epoxides, and mixtures thereof, and may be substituted with various substituents, such as halogen atoms, hydroxyl groups, ether radicals, and the like.

Preferably the epoxide is a cycloaliphatic epoxide. Exemplary cycloaliphatic epoxides include diepoxides of cycloaliphatic esters of dicarboxylic acids such as bis(3,4-epoxycyclohexylmethyl)adipate, bis(3,4-epoxycyclohexylmethyl)oxalate, bis(3,4-epoxy-6-methylcyclohexylmethyl)adipate, bis(3,4epoxycyclohexylmethyl)pimelate, and the like. Other cycloaliphatic epoxides include 3,4-epoxycyclohexylmethyl-3,4-epoxycyclohexane carboxylates such as 3,4-epoxycyclohexylmethyl-3,4-epoxycyclohexane carboxylate, 3,4-epoxy-1-methylcyclohexylmethyl-3,4-epoxy-1-methylcyclohexane carboxylate,- 6-methyl-3,4 -epoxycyclohexylmethyl-6-methyl-3,4-epoxycyclohexane carboxylate, 3,4-epoxy-2-methylcyclohexylmethyl-3,4-epoxy-2-methylcyclohexane carboxylate, 3,4-epoxy-3-methylcyclohexylmethyl-3,4-epoxy-3-methylcyclohexane carboxylate, 3,4-epoxy-5-methylcyclohexylmethyl-3,4-epoxy-5-methylcyclohexane carboxylate and the like. Commercially available cycloaliphatic epoxides useful in the invention include epoxides available from Union Carbide Corporation as the "Cyracure" series of materials, epoxides available from UCB Chemicals as the "UVACURE® series of materials, and the like.

Preferably the moisture content of the threadlines is controlled to maximize performance of a particular resin system. For example, the threadlines can be preconditioned or pretreated prior to coating to minimize moisture uptake and/or reduce moisture content. Alternatively, or in addition to preconditioning, the percent humidity of the coating environment can be controlled to maintain a percent relative humidity desirable for performance of a particular resin.

The cycloaliphatic epoxies can be used alone, as mixtures with one another, and as mixtures thereof with other types of epoxides, such as glycidyl type epoxides, aliphatic epoxides, epoxy resol novolac resins, epoxy phenol novolac resins, polynuclear phenol-glycidyl ether derived resins, aromatic and heterocyclic glycidyl amine resins, hydantoin epoxy resins, and the like and mixtures thereof. These epoxides are well known in the art and many are commercially available.

The epoxy can be present in amounts between about 99.9 and about 85 percent by weight of the composition.

Suitable photoinitiators include onium salts as known in the art for photoinitiating cure of epoxy resins. Such onium salts can have the general formula: $R_2I^+MX_n^-$, $R_3S^+MX_n^-$, $R_3Se^+MX_n^-$, $R_4P^+MX_n^-$, $R_4N^+MX_n^-$, wherein different radicals represented by R can be the same or different organic radicals containing 1 to 30 carbon atoms, including aromatic carbocyclic radicals containing 6 to 20 carbon atoms, which can be substituted with 1 to 4 monovalent radicals selected from the group consisting of C1–C8 alkoxyl, C1–C8 alkyl, nitro, chloro, bromo, cyano, carboxy, mercapto, and the like, and also including aromatic heterocyclic radicals including pyridyl, thiophenyl, pyranyl, and the like; and $MX_n^-$ is a non-basic, non-nucleophilic anion such as $BF_4^-$, $PF_6^-$, $AsF_6^-$, $SbF_6^-$, $HSO_4^-$, $ClO_4^-$ and the like as known in the art. The term "hetero" as used herein refers to linear or cyclic organic radicals having incorporated therein at least one non-carbon and non-hydrogen atom, and is not meant to be limited to the specific examples contained herein. Exemplary photoinitiators include triarylsulfonium complex salts, aromatic sulfonium or iodonium salts of halogen-containing complex ions, aromatic onium salts of Group VIa elements, aromatic onium salts of Group Va elements, and the like. Currently preferred photoinitiators include triarylsulfonium hexafluoroantimonate salts, triarylsulfonium hexafluorophosphate salts, mixtures thereof and the like. The photoinitiator is present in the radiation curable composition in conventional amounts, typically ranging from about 0.1% to about 15% by weight, based on the total weight of the composition.

Suitable radiation curable compositions are disclosed, for example, in U.S. Pat. Nos. 4,874,798; 4,593,051; and 4,818,776, the entire disclosure of each of which is hereby incorporated by reference.

In addition, the radiation curable composition can include a pigment capable of imparting color to the threadline. The pigment can be an organic or inorganic pigment, or a mixture thereof, as known in the art. Useful inorganic pigments include without limitation metallic oxides (iron, titanium, zinc, cobalt, chromium, and the like), metal powder suspensions (gold, aluminum, and the like), earth colors (siennas, ochers, umbers, and the like), lead chromates, carbon black, and the like and mixtures thereof. Useful organic pigments include without limitation animal pigments (rhodopsin, melanin, and the like), vegetable or plant pigments (chlorophylls, carotenoids, such as carotene and xanthophyll, flavanoids, such as catechins, flavones, flavanols, and anthocyanins, flavanones, leucoanthocyanidins, flavonols, indigo, and the like), synthetic organic pigments (phthalocyanone, lithos, toluidine, para red, toners, lakes, and the like), and the like and mixtures thereof.

Figure 3:
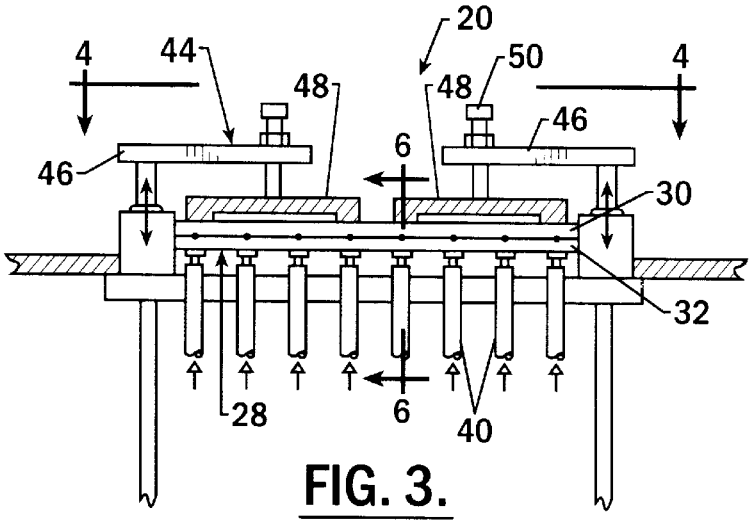
FIG. 3 is a cross sectional view of a sewing thread coating apparatus of the apparatus of FIG. 1, taken along line 3—3 thereof.

FIG. 3 illustrates a cross-sectional view of coating apparatus 20 of FIG. 1 taken along line 3—3. Coating apparatus 20 includes a horizontally split coating die 28 with upper and lower members 30 and 32, respectively, each member having a generally elongate shape with a rectangular or square cross-section. Die 34 is provided with a plurality of cavities or reservoirs 34 which are each in communication with a corresponding threadline entry port 22 and a threadline exit port 36. Lower member 32 of die 28 is also provided with a plurality of radial bores 38, each in fluid communication with an individual reservoir 34 and with the resin distribution manifold via one of a plurality of lines 40 to allow the radiation curable composition from source 24 to be fed into each reservoir 34. Each reservoir 34 preferably has a generally cylindrical shape which is tapered at the entry and exit ports, although other reservoir configurations can be used.

Figure 6:
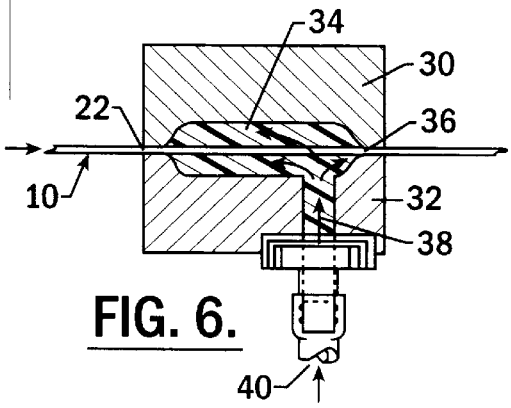
FIG. 6 is a greatly enlarged cross-sectional view of a cavity of the coating apparatus of FIG. 3, taken along line 6—6 thereof.
Figure 5:
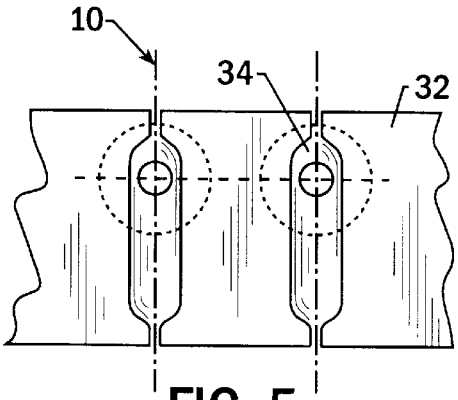
FIG. 5 is an enlarged top view of the broken away portion of the apparatus of FIG. 4 illustrating a resin reservoir therein.

Each threadline enters the coating apparatus via a discrete entry port 22 into a reservoir 34 and then exits the coating apparatus via an exit port 36. As best seen in FIGS. 5 and 6, the split coating die 22 is divided into the upper and lower members 30 and 32 along a plane that extends through the entry and exit ports 22 and 36 of each die cavity 34. This construction allows easy threading at start-up of the coating process when the upper member 30 of the split die is removed. The threadlines can be alternatively threaded through the coating apparatus 20 using an aspirator or other suitable means.

Pressurized radiation curable composition is directed from resin supply source 24 through line 26 to the resin distribution manifold and into each reservoir 34 via lines 40. As threadlines 10 pass through the coating apparatus, and in particular through reservoirs 34 filled with pressurized radiation curable composition, the threadlines are coated with the composition.

The pressure of the radiation curable composition within reservoirs 34 can vary, depending upon factors such as the working viscosity of the composition, the desired level of pickup, and the like. Advantageously, the composition is pressurized to assist with control of the desired level of pickup.

The inventors have also found that the invention can be used with a wide range of radiation curable composition viscosities, ranging from about 100 centipoise (cP) to about 8000 cP, and higher at room temperature. Preferably, the viscosity and pressure of the radiation curable composition within reservoir 56 are selected to provide a threadline pickup of about 1 to about 20 percent, and more preferably about 5 to about 12 percent. For example, in one advantageous embodiment of the invention, a radiation curable composition having a viscosity of about 500 to about 2000 cP is supplied within reservoir 56 at a pressure less than about 5 pounds per square inch (psi). Radiation curable compositions having higher viscosities can also be used in combination with higher pressures (for example, a viscosity of about 5000 to about 7000 cP at a pressure of about 30 to about 50 psi), to achieve comparable degree of resin pickup onto the threadline.

In addition to varying and controlling composition viscosity and pressure within reservoirs 34 to control pickup of the composition by the threadline, the coating process of the invention also includes a "contact coating" step to control pickup. As used herein, the term "contact coating" refers to applying the pressurized radiation curable composition to the exterior of the threadline within the coating apparatus 20 while also contacting the coated threadline with a suitable surface to impregnate the composition into the periphery of the threadline.

Figure 7:
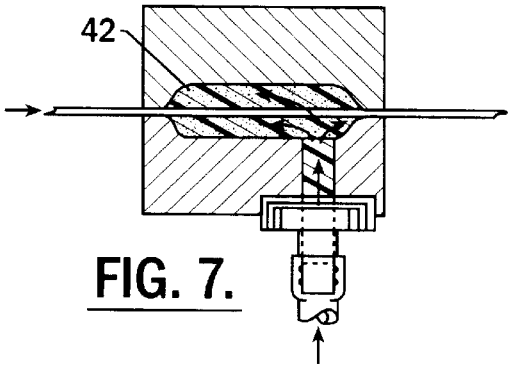
FIG. 7 is a greatly enlarged cross-sectional view of an alternative embodiment of a cavity of the coating apparatus of FIG. 3 illustrating the use of a porous, deformable contact media in the cavity.

In one embodiment of the invention, each exit port 36 of coating die 28 has a diameter which is slightly smaller than the cross sectional dimension of each of the threadlines 10. In this embodiment of the invention, the coated threadline contacts the edge of port 36 as the threadline passes therethrough. In another embodiment of the invention, a deformable porous media can be inserted into reservoir 34 which surrounds and contacts the threadline as it passes through the reservoir. For example, as illustrated in FIG. 7, a felt material 42 can be formed into a shape corresponding to the interior configuration of the reservoir 34, although other conformable, porous media can also be used. In this embodiment of the invention, this contact in effect "wipes" the coated threadline so as to control pickup. As a result of the contact coating step, the resultant threadline exhibits a thin layer of radiation curable composition that has been impregnated into the periphery of the threadline to provide a coated sewing thread which is structurally distinct from conventional sewing thread, as described in more detail below. Impregnation can be controlled, however, so that the resultant thread is not undesirably stiff due to excessive penetration of the resin into the thread structure.

This contact coating step contrasts with conventional processes for coating continuous substrates. For example, typically sewing thread is immersed in a low solids content solution of the bonding agent, passed through cooperating rotating rolls to remove excess bonding agent, and then heated to evaporate the solvent. However, this process can result in undesirable levels of resin pickup, which can result in excessively thick coating sheaths, wasted material, and the like. The pressure of the nip can be controlled to remove excess resin, but excessive pressure can cause the resin to impregnate the thread. This is typically avoided because of the resulting increased stiffness.

On the other hand, conventional die coating processes for coating wires, optical fibers and the like with a radiation curable composition typically include directing the optical fibers through a coating apparatus which includes a cavity filled with a pressurized radiation curable composition. However, in contrast to the present invention, typical wire and optical fiber coating processes do not include a contact coating step. Instead, the exit orifice of the die has a diameter greater than the diameter of the fiber or wire and acts as a cylindrical doctor blade to apply a continuous sheathlike coating of the composition to the wire or optical fiber. Great efforts are taken in these processes to prevent the coated fiber from contacting or touching any surface to prevent harming the optic fiber.

Figure 4:
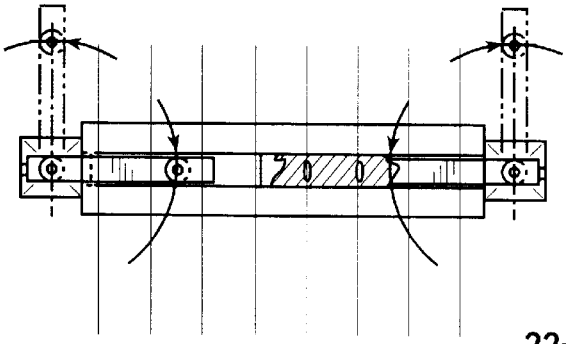
FIG. 4 is a partially broken top view of the coating apparatus of FIG. 3, taken along line 4—4 thereof.

Also as illustrated in FIGS. 3 and 4, coating apparatus 20 can include a clamping element 44 for applying substantially equalized clamping pressure to each reservoir 34. The clamping element 44 includes a pair of pivoting arms 46, each positioned for movement between a position that is non-aligned with the coating die 28, and a die contacting and pressure distributing position aligned with an upper outer surface of the coating die (illustrated by the arrows in FIG. 4). Each arm preferably applies clamping pressure to the upper portion of the split die via a pressure distributing bar 48 attached thereto via suitable fastening means, such as a threaded bolt 50.

When actuated, each arm 46 rotates from the noncontacting position inwardly towards coating die 28 until pressure distributing bars 48 rest upon an upper outer surface of the coating die 28. The pressure distributing bars advantageously provides substantially equalized pressure across each cavity 34 so as to control and equalize pickup of resin by individual threadlines passing therethrough.

Figure 8:
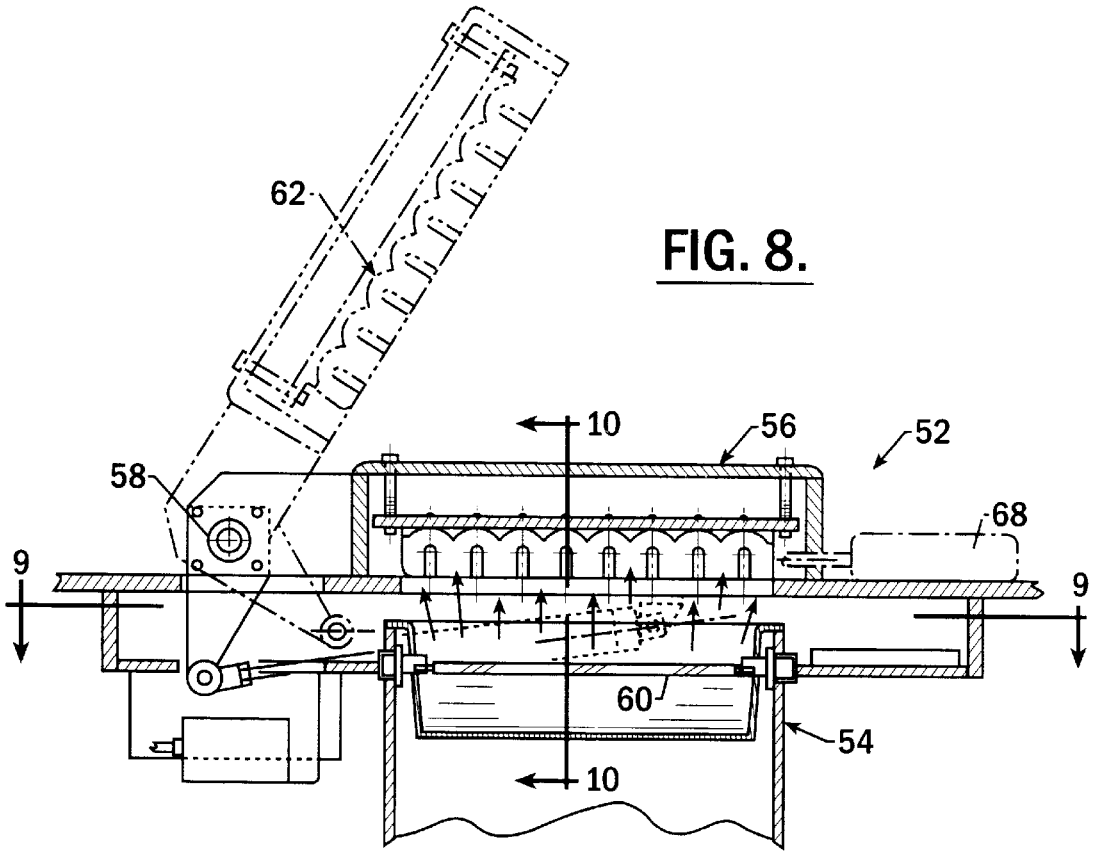
FIG. 8 a cross-sectional view of an ultraviolet (UV) radiation curing chamber of the apparatus of FIG. 1, taken along line 8—8 thereof.
Figure 9:
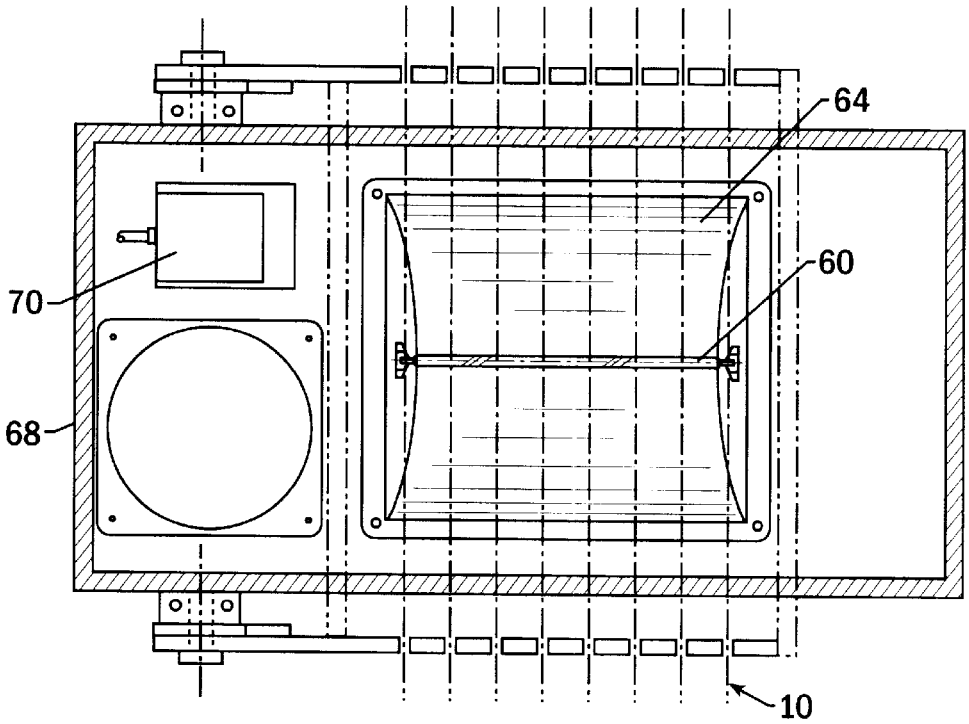
FIG. 9 is a top view of the UV radiation curing chamber of FIG. 8, taken along line 9—9 thereof.
Figure 10:
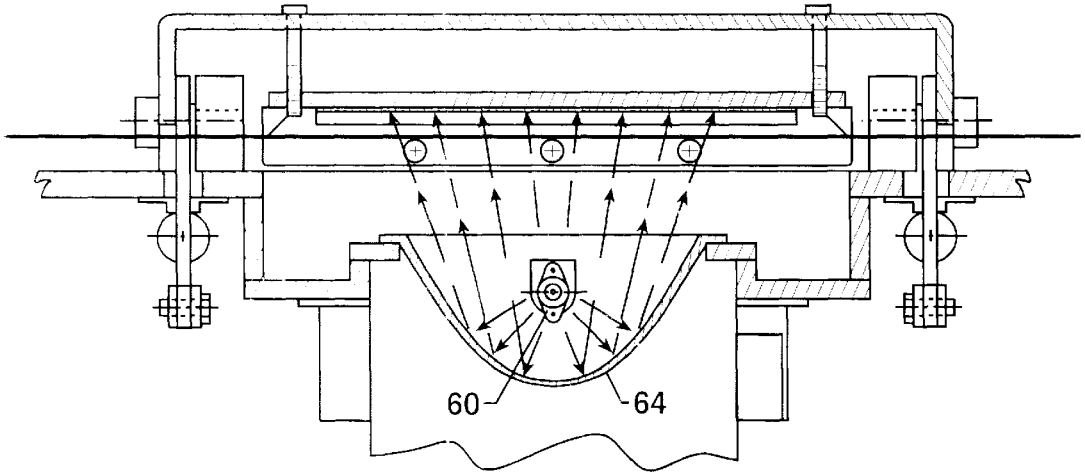
FIG. 10 is cross-sectional end view of the UV radiation curing chamber of FIG. 8, taken along line 10—10 thereof.

Returning again to FIGS. 1 and 2, after exiting the coating apparatus 20, the coated threadlines 10 are directed into a radiation curing chamber 50 via a plurality of conventional guides, not shown. As illustrated in FIG. 8, radiation curing chamber 50 includes a housing 52 comprising a base 54 and a cover 56 mounted for movement about a pivot 58. Disposed within the housing 52 is an elongate radiation source 60 oriented perpendicular to the path of the threadlines 10, which emits radiation of a suitable wavelength and intensity to initiate cure of the radiation curable composition on the threadlines. The radiation source 60 is mounted in a reflecting chamber within housing 52 to focus radiation emitted by the radiation source about each threadline. In a preferred embodiment as illustrated in FIGS. 8 and 10, the reflecting chamber includes an upper focusing reflector 62 oriented in the direction of the threadlines and a single elongate bottom diffusing reflector 64 oriented in the direction of the radiation source 60. Reflectors 62 and 64 can be formed of any of the types of material known in the art suitable for reflecting radiation.

The upper focusing reflector 62 includes a plurality of individual semicircular reflector cavities, each extending from a threadline entry port into the housing 52 to a threadline exit port out of the housing 52, and each having a longitudinal axis parallel to the path of the threadlines 10 through the radiation chamber. The bottom diffusing reflector 64 (FIG. 10) is preferably a single channel shaped cavity having a longitudinal axis perpendicular to the path of the threadline through the radiation chamber. The radiation source 60 and the reflecting chamber, including top focusing reflector 62 and bottom diffusing reflector 64, through which the threadlines travel are positioned so that substantially all of the periphery of the moving threadline is impinged by radiation emitted by the radiation source 60. Although not required, the curing chamber 50 can be continuously flooded or purged with an inert fluid, such as nitrogen, argon, helium, and the like to prevent or minimize adverse effects on the curing due to the presence of oxygen in the curing chamber.

If desired, housing 52 can be adapted to receive a suitable monitoring device to monitor energy levels emitted by radiation source 60, such as a probe 66 in FIG. 8. In addition, the curing chamber can include an exhaust duct 68 and cooling vent 70 to exhaust heat generated by the process from the chamber and to introduce cooling fluid into the chamber to thereby control temperature within the chamber.

Although the curing chamber as illustrated includes one radiation source, more than one radiation source can be included within the chamber. Alternatively, as illustrated in FIGS. 1 and 2, more than one curing chamber, designated as chambers 72 and 74, can be provided. In addition, although an elongate radiation source is illustrated perpendicular to the path of the threadlines, in an alterative embodiment of the invention, one or more elongate radiation sources can be used which are parallel to the threadlines.

The active energy beams used in accordance with the present invention may be ultraviolet light or may contain in their spectra both visible and ultraviolet light. The polymerization may be activated by irradiating the composition with ultraviolet light using any of the techniques known in the art for providing ultraviolet radiation, i.e., in the range of 240 nm and 420 nm ultraviolet radiation, or by irradiating the composition with radiation outside of the ultraviolet spectrum. The radiation may be natural or artificial, monochromatic or polychromatic, incoherent or coherent and should be sufficiently intense to activate polymerization. Conventional radiation sources include fluorescent lamps, mercury, metal additive and arc lamps. Variable irradiant platform lamps available from Fusion Systems, which emit a narrow wavelength band of 308 nm, are also advantageous in the present invention to more closely match the chemistry of the radiation curable composition. Coherent light sources are the pulsed nitrogen, xenon, argon ion- and ionized neon lasers whose emissions fall within or overlap the ultraviolet or visible absorption bands of the compounds of the invention.

The radiation time can depend on the intensity of the radiation source, the type and amount of photosensitizer and the permeability of the composition and the threadline to radiation. The threadline can be exposed to radiation for a period ranging from about 0.05 second to about 5 minutes. Irradiation can be carried out in an inert gas atmosphere but this is not required.

Returning to FIGS. 1 and 2, threadlines 10 exit the curing chamber(s), are directed between the nip of a capstan device defined by cooperating idle rolls 76 and 78, and taken up via a plurality of individual winders 80 for storage. Alternatively, the threadlines can be directed to additional downstream processing.

Also as illustrated in FIGS. 1 and 2, a computer control system 82 can be used to monitor threadline tension and detect breakage of a threadline. If a break is detected, the control system can actuate a value to close off the specific resin supply line 40 to the reservoir 34 associated with the broken threadline to stop resin feed into the reservoir to minimize resin loss. The control system can also deactivate the power supply to the threadline supply and/or wind up rolls associated with the broken threadline. Additionally, the control system can also monitor the coating resin supply.

The resultant coated sewing thread of the invention differs structurally from conventional coated sewing thread. As noted above, the radiation curable coating is applied so that the resin penetrates into the periphery of the sewing thread, preferably to a depth of one to about three single filament layers (or diameters). As a result, the peripheral filaments of the sewing thread are bonded to each other and in some cases to the next interior level of filaments. However, even though resin penetrates the thread, the sewing thread can be flexible and is suitable for conventional applications, and in particular for highly demanding industrial applications, such as assembly of densely woven fabrics used to produce shoes, soft luggage, and the like, and other dense materials such as leather.

Figure 11:
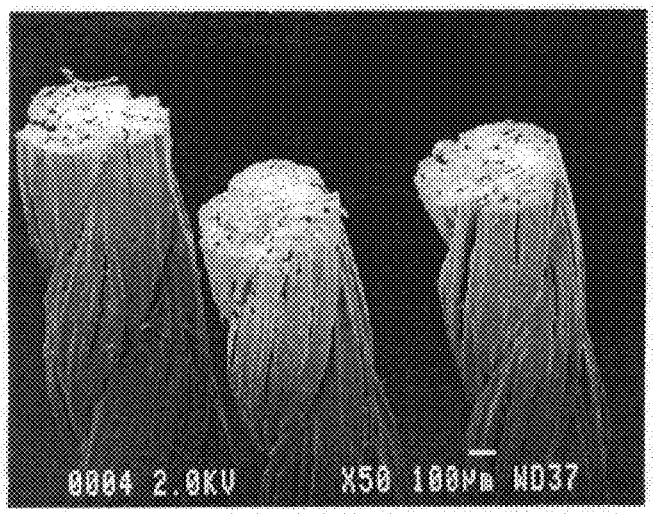
FIGS. 11, 12 and 13 are photographs illustrating a perspective view of a coated sewing thread of the invention and further illustrate penetration of the coating into the periphery of the sewing thread.
Figure 12:
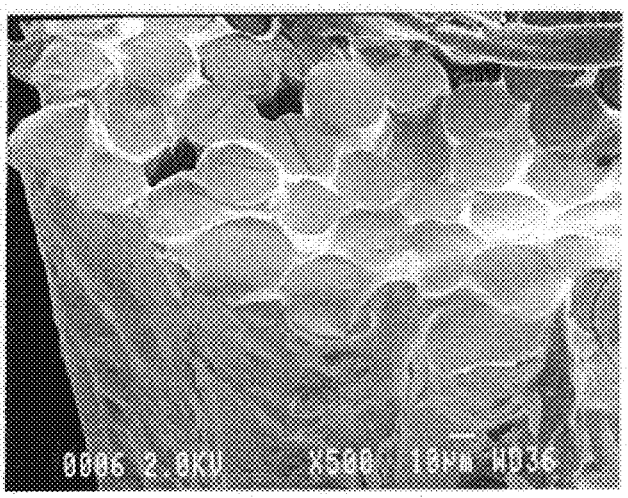
Figure 13:
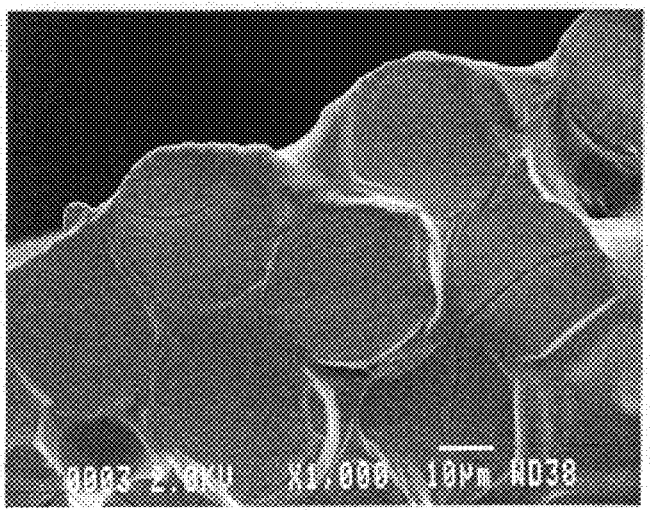

FIGS. 11 through 16 illustrate the structural differences between sewing thread coated with a conventional solvent system and sewing thread of the invention which is coated with a radiation curable, self sustaining polymerizable composition. FIGS. 11–13 are photographs illustrating perspective views of sewing thread coated in accordance with the present invention. As demonstrated by FIGS. 11–13, the resin penetrates into the periphery of the sewing thread for a distance of from one and up to about three filament diameters (and more in some cases), thus bonding the outer filaments to one another and to some of the immediately underlying interior filaments as well. Thus, in the coated sewing thread of the invention, the sheath or coating is integrated into the exterior filaments of the thread. Further, as illustrated by FIGS. 11–13, the thickness of the coating is not uniform, but rather can vary, for example, depending upon the degree of penetration of resin in a given location along the periphery of the thread. Further, for thread comprising more than one multifilament ply, the coating can fill in the gaps between plies, in contrast to thread coated with a solvent system in which the cast resin bridges the gap between plies. Still further, the thickness of the coating can vary depending upon the percent pickup, the denier of the thread, the number of filaments per cross section of the ply, and the like.

Figure 14:
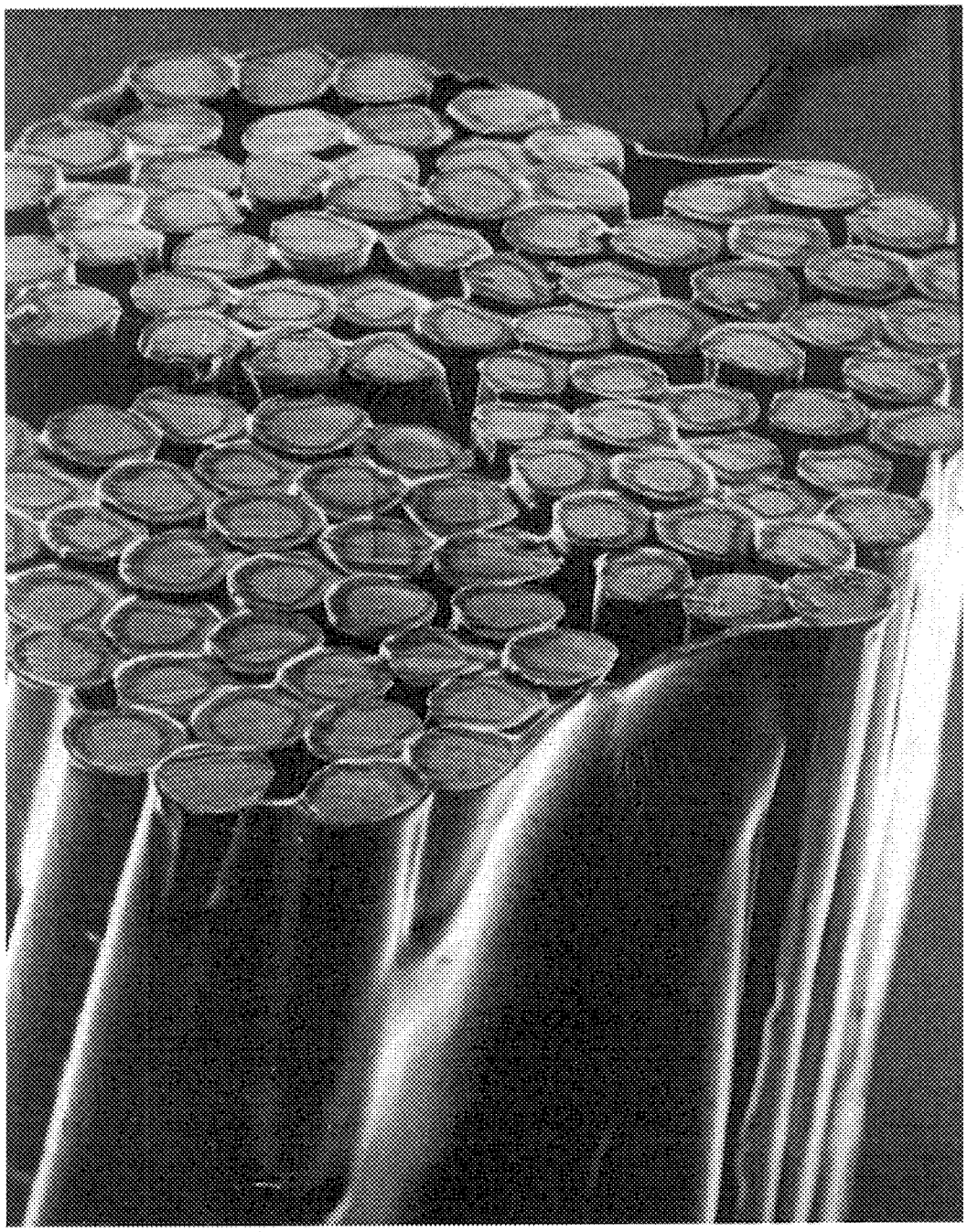
FIG. 14. (PRIOR ART)
FIG. 14 is a photograph illustrating a perspective view of a sewing thread prepared using a conventional solvent based coating system and illustrates how the conventional coating surrounds the thread without substantial penetration of the coating into the thread.

In contrast, as demonstrated by FIG. 14, which is a greatly enlarged perspective view of a solvent coated sewing thread (again using the Elvamide system), a continuous sheath of resin is formed around the sewing thread and does not extend substantially into the thread. In essence, the solvent based system is cast as a separate film surrounding the periphery of the thread, which remains as the continuous sheath after the solvent is evaporated.

Figure 15:
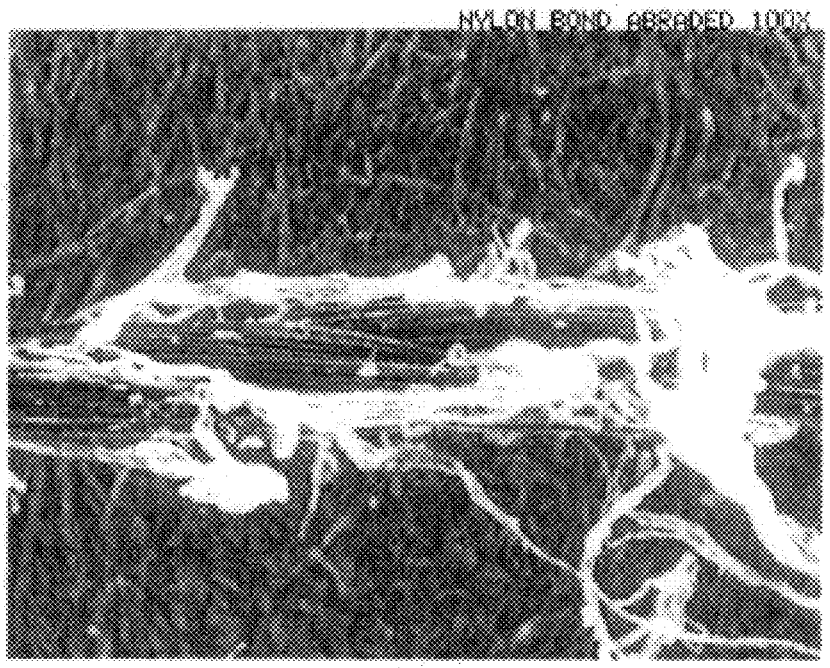
FIG. 15. (PRIOR ART)
FIG. 15 is a photograph illustrating a perspective view of an abraded prior art sewing thread coated with a conventional solvent based system and illustrates stripping of the coating caused by abrasive forces such as are encountered in sewing processes.
Figure 16:
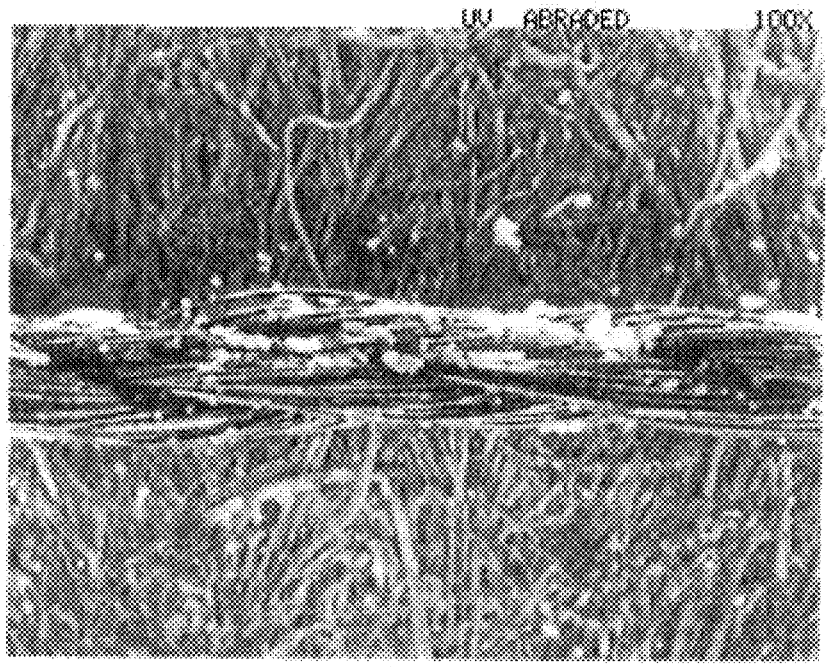
FIG. 16 is a photograph illustrating a perspective view of an abraded coated sewing thread of the invention and illustrates the absence of any substantial stripping of the coating.

FIG. 15 is a perspective view of an abraded sewing thread which was coated with a nylon solvent based system, commercially available as the Elvamide series from DuPont. When the sewing thread was subjected to an abrasion test that simulates abrasion applied to the thread by a sewing needle, the coating is removed as strips. These strips are sometimes visible as a white powder or flakes on sewn products. In contrast, as illustrated in FIG. 1G, when the coated sewing thread of the invention is subjected to the same abrasion conditions, minimal displacement of the coating is observed.

The foregoing is illustrative of the present invention and is not to be construed as limiting thereof.

That which is claimed is:

1. A process for coating sewing thread, comprising:

applying a radiation curable composition which exhibits a self sustaining reaction when exposed to radiation to a continuous threadline to impregnate the threadline with the composition to a depth of about one to about three single filament diameters; and exposing the threadline to radiation to form a coating bonding said impregnated filaments to one another.

2. The process of claim 1, wherein said exposing step comprises exposing the threadline to radiation to initiate a self sustaining reaction of the composition to form a coating of reacted composition on the threadline.

3. The process of claim 2, wherein said exposing step comprises exposing the threadline to radiation to initiate a substantially complete reaction of the radiation curable composition.

4. The process of claim 1, wherein the self sustaining reaction is a radiation initiated crosslinking reaction.

5. The process of claim 1, wherein the self sustaining reaction is a radiation initiated cationic crosslinking reaction.

6. The process of claim 1, wherein the radiation curable composition comprises an epoxy resin.

7. The process of claim 1, wherein said applying step further comprises contacting the exterior periphery of the threadline with a surface while applying the radiation curable composition to the threadline to impregnate the threadline with the radiation curable composition.

8. The process of claim 7, wherein said exposing step comprises exposing the threadline to radiation to initiate a self sustaining reaction of the radiation curable composition to bond impregnated filaments of the threadline to one another.

9. The process of claim 1, wherein said process comprises applying a radiation curable composition to more than one continuous threadline.

10. The process of claim 1, wherein said composition further comprises a pigment.

11. A process for coating sewing thread, comprising:

applying a radiation initiated, cationically curable composition to a continuous threadline;

contacting the exterior periphery of the coated threadline with a surface to control the amount of pickup of the threadline with the radiation curable composition and to impregnate the threadline with the composition to a depth of about one up to about three single filament diameters; and exposing the threadline to ultraviolet radiation to substantially completely react the composition to form a coating bonding said impregnated filaments to one another.

12. The process of claim 11, wherein said process comprises applying a cationically curable composition to more than one continuous threadline.

13. The process of claim 11, wherein said composition further comprises a pigment.

14. A process according to claim 11, wherein said contacting step further comprises providing a pickup of from about 1 to about 20 percent.

15. A process for coating sewing thread, comprising:

directing a continuous threadline into a cavity of a coating apparatus containing a radiation curable composition under pressure;

contacting the periphery of the threadline with a surface while applying pressurized radiation curable composition to coat the periphery of the threadline and to impregnate the threadline with radiation curable composition; and exposing the coated and impregnated threadline to radiation to initiate cure of the radiation curable composition.

16. The process of claim 15, wherein a deformable porous media is present in the cavity surrounding and contacting the threadline as it passes through the cavity; and wherein said contacting step comprises contacting the exterior periphery of the threadline with the deformable porous media while the pressurized radiation curable composition is applied to the threadline.

17. The process of claim 15, wherein said contacting step comprises contacting the exterior periphery of the threadline to impregnate the threadline with the composition to a depth of at least about one to about three single filament diameters.

18. The process of claim 15, wherein said coating apparatus comprises a coating die having a plurality of cavities which are each in communication with a corresponding threadline entry port and a threadline exit port and each containing a radiation curable composition, and wherein said process comprises directing a plurality of continuous threadlines into said coating apparatus by directing each threadline into the coating apparatus via a discrete entry port into a cavity and exiting the coating apparatus via an exit port.

19. The process of claim 18, wherein said exposing step comprises directing said plurality of threadlines from said coating apparatus past a radiation source oriented perpendicular to the path of the threadlines.

20. The process of claim 15, wherein said composition further comprises a pigment.

21. The process of claim 15, wherein said continuous threadline comprises three multifilament plies which are individually twisted in a first direction and then combined by twisting in an opposite direction to produce a multiple ply thread, wherein the multiple ply thread includes longitudinally extending gaps between each of the three multifilament plies; and wherein said contacting step applies said radiation curable composition in the gaps between the plies.

22. The process of claim 15, wherein the coating apparatus comprises an entry port through which the threadline enters the cavity and an exit port through which the threadline exits the cavity, said exit port having a diameter which is smaller than the diameter of the threadline; and wherein said contacting step comprises contacting the exterior periphery of the threadline with the edge of the exit port while the pressurized radiation curable composition is applied to the threadline.

23. A process according to claim 15, wherein said applying step further comprises applying pressurized radiation curable composition having a viscosity ranging from about 100 to about 8000 cP and a pressure ranging from less than about 5 psi to about 50 psi.

24. A process according to claim 23, wherein said viscosity is about 500 to about 2000 cP and said pressure is less than about 5 psi.

* * * * *

UNITED STATES PATENT AND TRADEMARK OFFICE

CERTIFICATE OF CORRECTION

PATENT NO. : 6,436,484 B1
DATED : August 20, 2002
INVENTOR(S) : Broome et al.

It is certified that error appears in the above-identified patent and that said Letters Patent is hereby corrected as shown below:

Title page,
Item [56], References Cited, FOREIGN PATENT DOCUMENTS,
"63-270854" should read -- 63-270864 --.

Signed and Sealed this

Seventh Day of January, 2003

JAMES E. ROGAN
*Director of the United States Patent and Trademark Office*